US010985495B1

(12) United States Patent
Hack et al.

(10) Patent No.: US 10,985,495 B1
(45) Date of Patent: Apr. 20, 2021

(54) HIGH VOLTAGE CONNECTOR WITH WET CONTACTS

(71) Applicants: Harvey Paul Hack, Arnold, MD (US); James Richard Windgassen, Chester, MD (US)

(72) Inventors: Harvey Paul Hack, Arnold, MD (US); James Richard Windgassen, Chester, MD (US)

(73) Assignee: NORTHROP GRUMMAN SYSTEMS CORPORATION, Falls Church, VA (US)

( * ) Notice: Subject to any disclaimer, the term of this patent is extended or adjusted under 35 U.S.C. 154(b) by 0 days.

(21) Appl. No.: 16/798,934

(22) Filed: Feb. 24, 2020

(51) Int. Cl.
*H01R 13/03* (2006.01)
*H01R 13/523* (2006.01)
*H01R 43/00* (2006.01)

(52) U.S. Cl.
CPC ..... *H01R 13/523* (2013.01); *H01R 13/03* (2013.01); *H01R 43/005* (2013.01)

(58) Field of Classification Search
CPC ..... H01R 12/716; H01R 12/73; H01R 13/52; H01R 13/5216; H01R 13/5219; H01R 13/523; H01R 13/62938; H01R 43/005; H01R 43/205
See application file for complete search history.

(56) References Cited

U.S. PATENT DOCUMENTS 3,475,795 A 11/1969 Youngblood
4,160,609 A 7/1979 Jackson et al.
4,338,149 A 7/1982 Quaschner
4,466,184 A 8/1984 Cuneo et al.
4,687,695 A 8/1987 Hamby
4,715,928 A 12/1987 Hamby
5,130,691 A 7/1992 Shintaku et al.
5,160,269 A 11/1992 Fox, Jr. et al.
5,161,981 A 11/1992 Deak et al.
5,419,038 A 5/1995 Wang et al.
5,854,534 A 12/1998 Beilin et al.
6,040,624 A 3/2000 Chambers et al.
(Continued)

FOREIGN PATENT DOCUMENTS

JP S5830174 A 2/1983
JP 2002064271 A 2/2002

OTHER PUBLICATIONS

Final Office Action for U.S. Appl. No. 16/439,415 dated Feb. 25, 2020.

(Continued)

*Primary Examiner* — Truc T Nguyen
(74) *Attorney, Agent, or Firm* — Tarolli, Sundheim, Covell & Tummino LLP

(57) ABSTRACT

A high-voltage underwater electrical connector is provided that includes first and second connectors each having a positive contact and a negative contact. The electrical connector further includes an auxiliary electrode made from a conductive material electrically connected to the first positive contact. A voltage limiting circuit electrically connects the auxiliary electrode to the positive contact. A high resistance water pathway is created between the auxiliary electrode and the negative contacts when the first and second connectors are mated while immersed in water or other corrosive environments.

20 Claims, 4 Drawing Sheets

(56) References Cited

U.S. PATENT DOCUMENTS

| | | | | |
|---|---|---|---|---|
| 6,603,079 | B2 | 8/2003 | Biron | |
| 6,793,544 | B2 | 9/2004 | Brady et al. | |
| 6,924,551 | B2 | 8/2005 | Rumer et al. | |
| 7,012,812 | B2 | 3/2006 | Haba | |
| 7,251,712 | B2 | 7/2007 | Unno | |
| 7,407,408 | B1 | 8/2008 | Taylor | |
| 7,911,029 | B2 | 3/2011 | Cui | |
| 8,118,611 | B2 | 2/2012 | Jeon | |
| 8,262,873 | B2 | 9/2012 | Wurm et al. | |
| 8,359,738 | B2 | 1/2013 | Takahashi et al. | |
| 9,197,006 | B2 | 11/2015 | Hack | |
| 9,485,860 | B2 | 11/2016 | Yosui | |
| 9,743,529 | B2 | 8/2017 | Lee et al. | |
| 9,893,460 | B2 | 2/2018 | Windgassen et al. | |
| 2003/0114026 | A1 | 6/2003 | Caldwell | |
| 2004/0043675 | A1 | 3/2004 | Hiatt et al. | |
| 2004/0049914 | A1 | 3/2004 | Wang et al. | |
| 2009/0014205 | A1 | 1/2009 | Kobayashi et al. | |
| 2010/0063555 | A1 | 3/2010 | Janzig et al. | |
| 2010/0112833 | A1 | 5/2010 | Jeon | |
| 2012/0042481 | A1 | 2/2012 | Kempf | |
| 2013/0089290 | A1 | 4/2013 | Sloey et al. | |
| 2013/0196855 | A1 | 8/2013 | Poletto et al. | |
| 2014/0175671 | A1 | 6/2014 | Haba et al. | |
| 2014/0270645 | A1* | 9/2014 | Toth | G02B 6/3849 385/58 |
| 2014/0353014 | A1 | 12/2014 | Lai | |
| 2014/0364004 | A1 | 12/2014 | Oniki | |
| 2015/0011107 | A1* | 1/2015 | Hack | H01R 13/52 439/206 |
| 2015/0055914 | A1 | 2/2015 | Dell Anno et al. | |
| 2016/0014893 | A1 | 1/2016 | Yosui | |
| 2016/0190719 | A1* | 6/2016 | Brzezinski | H01R 12/73 439/74 |
| 2016/0233607 | A1* | 8/2016 | Windgassen | H01R 13/523 |
| 2017/0201039 | A1* | 7/2017 | Jenkin | E21B 33/0385 |
| 2017/0239862 | A1* | 8/2017 | Mentzel | B29C 45/1676 |
| 2018/0160304 | A1 | 6/2018 | Liu et al. | |
| 2019/0027800 | A1 | 1/2019 | El Bouayadi et al. | |
| 2019/0067858 | A1* | 2/2019 | Kloss | H01R 13/2414 |
| 2019/0074568 | A1 | 3/2019 | Henry et al. | |
| 2019/0165559 | A1* | 5/2019 | Iversen | H02G 15/10 |
| 2020/0006655 | A1 | 1/2020 | Tang et al. | |
| 2020/0069855 | A1 | 3/2020 | Matthes et al. | |
| 2020/0083927 | A1 | 3/2020 | Henry et al. | |
| 2020/0190914 | A1* | 6/2020 | Stark | H01R 13/03 |
| 2020/0295502 | A1* | 9/2020 | Tanaka | H01R 43/005 |
| 2020/0300055 | A1* | 9/2020 | Vangasse | H04B 1/38 |
| 2020/0388952 | A1* | 12/2020 | Windgassen | H01R 4/62 |

OTHER PUBLICATIONS

Japanese Office Action for Application No. 2019-5285086 dated Jul. 21, 2020

Korean Office Action for Application No. 10-2019-7015946 dated Jan. 28, 2021.

International Search Report for Application No. PCT/US2020/054257 dated Jan. 21, 2021.

Non Final Office Action for U.S. Appl. No. 15/930,596 dated Feb. 2, 2021.

* cited by examiner

HIGH VOLTAGE CONNECTOR WITH WET CONTACTS

TECHNICAL FIELD

This disclosure relates generally to electrical connectors, and more specifically to an underwater electrical connector that includes wet contacts made from self-passivating transition metals.

BACKGROUND

To avoid water contamination of electrical contacts, conventional electrical connectors may be sealed with O-rings or gaskets. These designs may work well in generally dry environments however electrical connectors in some applications may be exposed to non-dry air environments, such as humid air, rain, or seawater. In addition, an electrical connector may be submerged in water for use in underwater electrical applications. Thus, it may be desirable to exclude water from the electrically live portions (e.g., contacts, electrodes, etc.) of the connectors as, among other things, water may create electricity leakage paths. Water can damage the electrically conducting connector contacts by corrosion or by deposition of insulating salts or impurities onto the connectors. In addition, applying a voltage to an electrical contact when the contact is exposed to water increases the rate of corrosion to the contact. Thus, in certain applications and environments, it is desirable to not only exclude water after being mated, but also to exclude water during mating—even when mating under water.

Conventional connectors addressing underwater mating or mating in a wet environment may be complex. Such connectors may be filled with oil and may have many small parts, such as dynamic seals and springs, for example. Due, at least in part, to their complexity, conventional connectors may be difficult to build and repair. Such connectors may also be expensive to produce and replace. Dielectric gel containing connectors can also be designed to allow underwater mating of connectors with water exclusion, for example. Repeated connection and disconnection of these gel-containing connectors however, may lead to contamination, leakage of the gel, or other problems.

SUMMARY

The following presents a simplified summary in order to provide a basic understanding of the subject disclosure. This summary is not an extensive overview of the subject disclosure. It is not intended to identify key/critical elements or to delineate the scope of the subject disclosure. Its sole purpose is to present some concepts of the subject disclosure in a simplified form as a prelude to the more detailed description that is presented later.

One example of the subject disclosure includes a system that includes a first connector having a first positive contact and a first negative contact, and a second connector having a second positive contact and a second negative contact. The first and second positive contacts are made from the self-passivating transition metal, wherein the self-passivating transition metal has a property of forming a non-conductive outer layer on the first positive contact and the second positive contact when immersed in water. An auxiliary electrode that is made from a conductive material is electrically connected through a voltage limiting device such as a Zener diode, transistor or other electronic circuit to either the first positive contact or the second positive contact and is spaced apart from a mating end of the first positive contact and the second positive contact. Without this auxiliary electrode, if the first positive contact is mated with the second positive contact while immersed in water and a high voltage source is applied between the positive contacts and the negative contacts that exceeds the breakdown voltage of the self-passivating transition metal then the positive contact will corrode. In the subject disclosure, a high resistance water pathway is created from both negative contacts to the auxiliary electrode and the auxiliary electrode is configured to pass current into and along the high resistance water pathway to create a voltage drop in the water between the auxiliary electrode and both negative contacts. This limits the voltage applied to both positive contacts relative to the water to a voltage below the breakdown voltage of the self-passivating transition metal due to potential drop through the high-resistance path.

Another example of the subject disclosure includes a high-voltage underwater electrical connector that includes a first positive contact made from a self-passivating transition metal and a second positive contact made from a self-passivating transition metal that mates with the first positive contact. The first positive contact and the second positive contact are made from the self-passivating transition metal, wherein the self-passivating transition metal has a property of forming a non-conductive outer layer on the first positive contact and the second positive contact when immersed in water. The connector further includes a first negative contact and a second negative contact that mates with the first negative contact. An auxiliary electrode that is made from a conductive material is electrically connected to the first positive contact through a voltage limiting device such as a Zener diode, transistor or other electronic circuit and spaced apart from a mating end of both positive contacts. The voltage limiting device creates a voltage between both positive contacts and the auxiliary electrode. A high resistance water pathway is created from both negative contacts to the auxiliary electrode and the auxiliary electrode is configured to pass current into and along the high resistance water pathway to create a voltage drop in the water between both negative contacts and the auxiliary electrode. This limits the voltage applied to both positive contacts relative to the water to a voltage below the breakdown voltage of the self-passivating transition metal.

BRIEF DESCRIPTION OF THE DRAWINGS

The accompanying drawings, which are incorporated in and constitute a part of the specification, illustrate various systems, methods, and other examples of the disclosure. Illustrated element boundaries (e.g., boxes, groups of boxes, or other shapes) in the figures represent one example of the boundaries. In some examples one element may be designed as multiple elements or multiple elements may be designed as one element. In some examples, an element shown as an internal component of another element may be implemented as an external component and vice versa.

DETAILED DESCRIPTION

Figure 1:
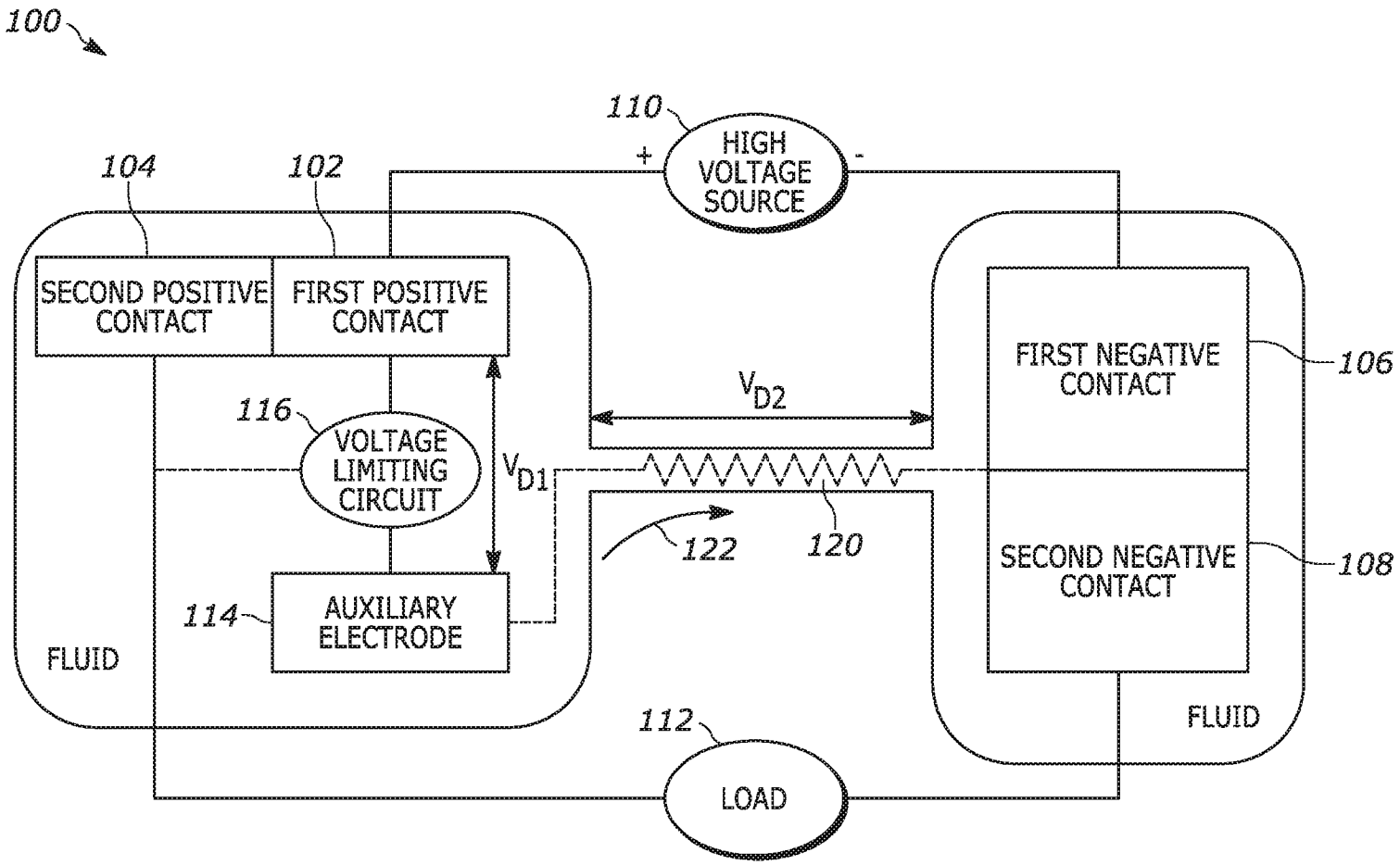
FIG. 1 is an example schematic illustration of a high voltage electrical connector.

The disclosure is now described with reference to the drawings, wherein like reference numerals are used to refer to like elements throughout. In the following description, for purposes of explanation, numerous specific details are set forth in order to provide a thorough understanding of the subject disclosure. It may be evident, however, that the subject disclosure can be practiced without these specific details. In other instances, well-known structures and devices are shown in block diagram form in order to facilitate describing the subject disclosure.

While specific characteristics are described herein (e.g., thickness, orientation, configuration, etc.), it is to be understood that the features, functions and benefits of the subject disclosure can employ characteristics that vary from those described herein. These alternatives are to be included within the scope of the disclosure and claims appended hereto.

Disclosed herein is an example high voltage electrical connector for use in corrosive environments such as in fluids, such as water (e.g., seawater, saltwater, well water, river water, lake water, etc.) that includes contacts made from a self-passivating transition metal (e.g., niobium, tantalum, titanium, zirconium, molybdenum, ruthenium, rhodium, palladium, hafnium, tungsten, rhenium, osmium, iridium, etc.). For purposes herein, the connector will be referred to as a "high-voltage underwater connector" and described as being immersed in a corrosive environment such as water, but it is understood that the corrosive environment can be any type of fluid. Self-passivating transition metals form an insulation layer or non-conductive passivation outer layer on the surface of the contact to protect the contact from the corrosive effects of an aggressive environment (e.g., seawater, saltwater, well water, river water, lake water, etc.), as described in U.S. Pat. No. 9,893,460, which is incorporated herein by reference in its entirety. Self-passivating transition metal contacts however, are limited in applications at sufficiently high voltages (e.g. approximately 120 volts for niobium in seawater) due to the breakdown of the self-passivating layer at higher voltages. Thus, at voltages exceeding the breakdown voltage, the contacts lose their insulating layer and leak current into the water and are then subject to corrosion.

The underwater electrical connector disclosed herein overcomes this voltage limitation by implementing an auxiliary (or guard) electrode electrically connected to a positive self-passivating transition metal contact through a voltage limiting device such as a Zener diode, transistor, or other electronic circuit. A high resistance water pathway, as described in U.S. Pat. No. 9,197,006, and which is incorporated herein by reference in its entirety, provides a voltage drop in the water, which in turn creates a voltage differential between the transition metal contacts and the water that is less than the breakdown voltage of the transition metal contacts. Specifically, the auxiliary electrode is made from a material (e.g., platinum, graphite, mixed-metal oxides, etc.) that easily passes current into a high resistance water pathway. As current passes into the water pathway, a voltage drop occurs across the water pathway between the auxiliary electrode and negative contacts of the connector. The voltage drop creates a voltage differential between the transition metal contacts and the water that is less than the breakdown voltage of the transition metal contacts. In other words, the voltage of the transition metal contacts relative to the surrounding water is limited to the voltage of the voltage limiting device, which is designed to be less than the breakdown voltage of the transition metal contacts. As a result, electrical contacts made from transition metals which normally cannot be used in water at voltages greater than their breakdown voltage can be used in applications (e.g., power transfers, transfer of data, etc.) at much higher voltages with the implementation of the auxiliary electrode and the high resistance water pathway in a specific connector configuration without degradation of the insulating layer.

FIG. 1 schematically illustrates an example of a system to enable mating and un-mating of exposed electrical connections in an underwater environment. Specifically, disclosed herein is a system comprised of a high voltage underwater electrical connector 100 that includes transition metal contacts suitable for mating and un-mating of exposed electrical contacts in an underwater environment due to the formation of the non-conductive passivation outer layer. The term contact can refer to any type of electrically conducting mating component, such as pins, receptors, plates, etc. The transition metal contacts are positive contacts and are comprised of a first positive contact 102 that mates with a second positive contact 104. The electrical connector 100 further includes a first negative contact 106 that mates with a second negative contact 108 both made from a conductive material (e.g., copper, graphite, mixed-metal oxides, aluminum etc.). The first positive contact 102 is connected to the first negative contact 106 via a voltage source 110 greater than the breakdown voltage. The second positive contact 104 is connected to the second negative contact 108 via a load 112 to form a load circuit. An auxiliary (guard) electrode 114 is connected to the first positive contact 102 (or alternatively to the second positive contact 104 as illustrated by the dashed line) via a voltage limiting circuit 116 (e.g., voltage divider circuit, Zener diode, transistors, etc.). The voltage limiting circuit 116 is sized to be lower than a breakdown voltage of the transition metal contacts 102, 104.

In order to prevent the transition metal contacts 102, 104 from exceeding its breakdown voltage, a voltage $V_{D1}$ is created between the positive contacts 102, 104 and the auxiliary electrode 114 by the voltage limiting circuit 116, and a voltage drop $V_{D2}$ is created between the auxiliary electrode 114 and the negative contacts 106, 108. This is accomplished by establishing a high resistance fluid (e.g., water) path (e.g., channel) 120 (schematically represented by a dotted line resistor) between the auxiliary electrode 114 and the negative contacts 106, 108 when the positive contacts 102, 104 and the negative contacts 106, 108 are mated. Since resistance is proportional to a length that the current flows and inversely proportional to the cross-sectional area of the path, narrowing or lengthening the water path, 120 results in a high resistance path.

As mentioned above, the auxiliary electrode 114 is made from a material that allows current to leak (leakage current 122) into the water path 120 (normal operation of the transition metal contacts 102, 104 does not allow significant current to flow, thus the reason for the auxiliary electrode 114). When power is supplied to the connector 100 via the high voltage source 110, the leakage current 122 flows through the water path 120 from the auxiliary electrode 114 to the first and second negative contacts 106, 108, which creates the voltage drop $V_{D2}$ along the water path 120. The voltage drop $V_{D2}$ creates a voltage in the water that is approximately equal to the applied voltage from the high voltage source 110 minus the voltage across the voltage limiting circuit 116, i.e., between the auxiliary electrode 114 and the positive contacts 102, 104. Thus, the voltage drop $V_{D2}$ creates a voltage differential between the transition metal contacts 102, 104 and the water that is approximately equal to the applied voltage minus the voltage across the voltage limiting circuit 116, which is less than the breakdown voltage of the positive (transition metal) contacts 102, 104. This limits the voltage of the positive (transition metal) contacts 102, 104 relative to the water to be less than their breakdown voltage of the transition metal contacts 102, 104. Thus, the voltage on the positive contacts 102, 104 does not exceed the breakdown voltage of the transition metal and thus, can be used in high voltage (voltages exceeding the breakdown voltage of the transition metal) applications.

Figure 2:
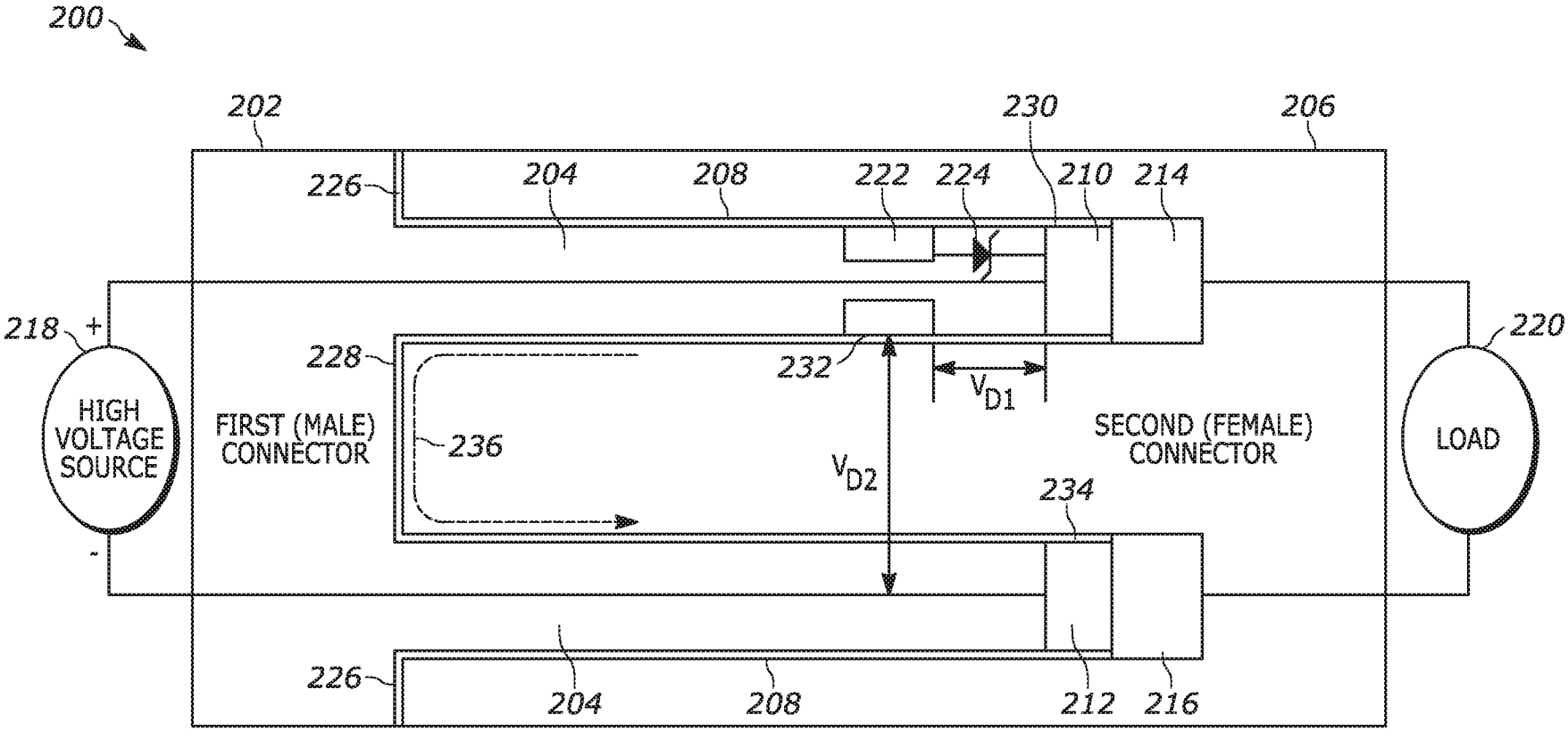
FIG. 2 is a diagram of an example high voltage electrical connector.

FIG. 2 is an example high voltage underwater electrical connector 200 that includes a first (male) connector 202 having fingers 204 and a second (female) connector 206 that includes holes or sockets 208 to receive the fingers 204. Disposed at an end of one finger 204 is a first (transition metal) positive contact 210 and at an end of another finger 204 is a first negative contact 212. A second (transition metal) positive contact 214 is disposed inside one socket 208 and a second negative contact 216 disposed in another socket 208. When the first and second connectors 202, 206 are mated, the fingers 204 extend into the sockets 208 such that the first positive contact 210 and the first negative contact 212 engage and mate with the second positive contact 214 and the second negative contact 216 respectively to form a tight fit. The tight fit between the fingers 204 and the holes 208 provides a high electrolyte resistance that facilitates in the operation of the high voltage connector 200. When the first and second connectors 202, 206 are mated at least a portion of the self-passivation layer is removed (scraped off) on each of the first and second positive contacts 210, 214 to form an electrically conductive connection. A high voltage source 218 (e.g., greater than the breakdown voltage of contacts 210 and 214) provides power to the positive and negative contacts 210, 212 of the first connector 202. A load 220 is connected to the positive and negative contacts 214, 216 of the second connector 206. Thus, the high voltage source 218 provides power to and drives the load 220.

The positive contacts 210, 214 of the first and second connectors 202, 206 respectively are made from a self-passivating transition metal (e.g., niobium, tantalum, titanium, zirconium, molybdenum, ruthenium, rhodium, palladium, hafnium, tungsten, rhenium, osmium, iridium, etc.). As mentioned above, self-passivating transition metals form an insulation layer or skin on the surface of the contact to protect the contact from the corrosive effects of water. Self-passivating transition metal contacts however, are limited to a material and environment specific breakdown voltage (approximately 120 volts for niobium in seawater) due to the breakdown of the self-passivating layer at higher voltages.

Thus, an auxiliary (guard) electrode 222 is provided to facilitate in limiting the voltage of the positive contacts 210, 214 relative to the surrounding water to a value that is less the breakdown voltage of the positive contacts 210, 214, as described herein. The auxiliary electrode 222 is made from a material that easily passes current into the water such as platinum, graphite, or mixed-metal oxides and is disposed on the same finger 204 as the positive contact 210 of the first connector 202, but not as deep as the positive contact 210. The auxiliary electrode 222 forms a ring around the finger 204. The auxiliary electrode 222 is electrically connected to the first positive contact 210 via a voltage limiting circuit 224 (e.g., voltage divider circuit, Zener diode (illustrated in FIG. 2), transistors, etc.). The voltage limiting circuit 224 is disposed inside the finger 204 to protect it from the water and is sized to be lower than the breakdown voltage of the positive contacts 210, 214. In the example where the voltage limiting circuit 224 includes a Zener diode, the voltage between the positive contacts 210, 214 and the auxiliary electrode 222 is limited to the Zener diode voltage.

When the connector 200 is connected, a high resistance fluid (e.g., water) path (e.g., channel) is established along the fingers 204 of the first connector 202 and the sockets 208 of the second connector 206. Specifically, a high resistance water path 228 extends from the auxiliary electrode 222 to the negative contacts 212, 216. In addition, the high resistance water path 228 is in contact with the contact surface 232 of the auxiliary electrode 222, and a contact surface 234 of the first negative contact 212.

During operation, the auxiliary electrode 222 passes or leaks current (leakage current) 236 into the water path 228 which creates a voltage drop $V_{D2}$ between the auxiliary electrode 222 and the negative contacts 212, 216. The voltage drop $V_{D2}$ creates a voltage in the water that is approximately equal to the applied voltage from the high voltage source 218 minus the first voltage drop $V_{D1}$ across the voltage limiting circuit 224, i.e., between the auxiliary electrode 222 and the positive contacts 210, 214. Thus, the applied voltage is reduced by the voltage drop through the water path, $V_{D2}$, to $V_{D1}$ which is less than the breakdown voltage of the transition metal contacts 210, 214. Thus, the voltage on the positive contacts 210, 214 does not exceed the breakdown voltage of the transition metal and thus, can be used in high voltage (voltages exceeding the breakdown voltage of the transition metal) applications.

Figure 3:
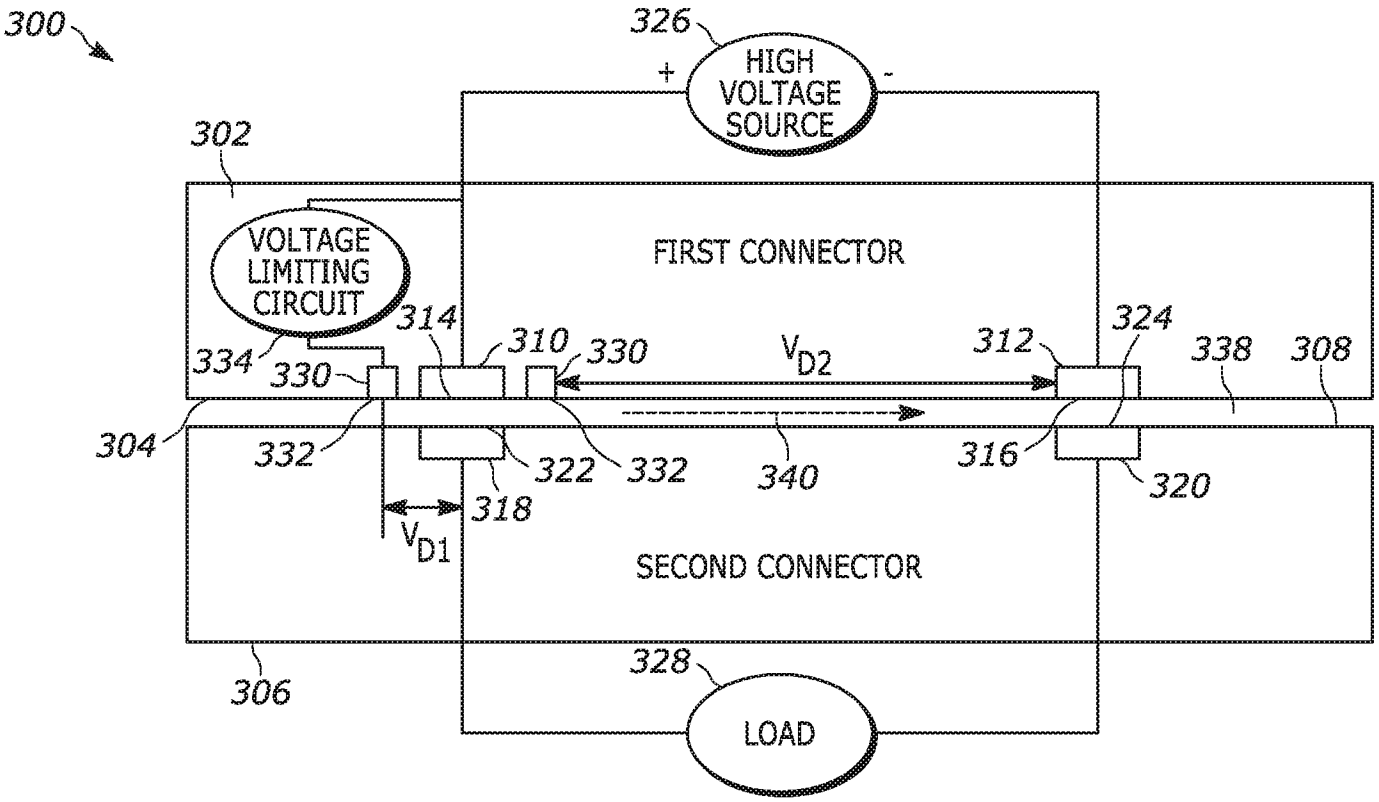
FIG. 3 is another example of a high voltage electrical connector.

FIG. 3 is another example of a high voltage underwater electrical connector 300 that includes a first connector 302 having a first face 304 and a second connector 306 having a second face 308 that faces the first face 304. The first connector 302 includes a first (transition metal) positive contact 310 and a first negative contact 312. The first positive and negative contacts 310, 312 are disposed in the first connector 302 such that contact surfaces 314, 316 of the first positive and negative contacts 310, 312 respectively are flush with the face 304 of the first connector 302. The second connector 306 includes a second (transition metal) positive contact 318 and a second negative contact 320. The second positive and negative contacts 318, 320 are disposed in the second connector 306 such that contact surfaces 322, 324 of the second positive and negative contacts 318, 320 respectively are flush with the face 308 of the second connector 306.

A high voltage source 326 (e.g., greater than the breakdown voltage of the positive contacts 310 and 318) provides power to the positive and negative contacts 310, 312 of the first connector 302. A load 328 is connected to the positive and negative contacts 318, 320 of the second connector 306. Thus, the high voltage source 326 provides power to and drives the load 328.

The positive contacts 310, 318 of the first and second connectors 302, 306 respectively are made from a self-passivating transition metal (e.g., niobium, tantalum, titanium, zirconium, molybdenum, ruthenium, rhodium, palladium, hafnium, tungsten, rhenium, osmium, iridium, etc.). As mentioned above, self-passivating transition metals form an insulation layer or skin on the surface of the contact to protect the contact from the corrosive effects of the environment. Self-passivating transition metal contacts however, are limited in voltage due to the breakdown of the self-passivating layer at higher voltages.

Thus, an auxiliary (guard) electrode 330 is provided to facilitate in limiting the voltage of the positive contacts 310, 318 relative to the water to a value that is less the breakdown voltage of the positive contacts 310, 318, as described herein. The auxiliary electrode 330 is made from a material that easily passes current into the water such as platinum, graphite, or mixed-metal oxides and is disposed in the first connector 302. The auxiliary electrode 330 forms a ring around the first positive contact 310. The auxiliary electrode 330 is disposed in the first connector 302 such that a contact surface 332 of the auxiliary electrode 330 is flush with the face 304 of the first connector 302. The auxiliary electrode 330 can instead be disposed in the second connector 306 as a ring around the second positive contact 318. The auxiliary electrode 330 is electrically connected to the first positive contact 310 via a voltage limiting circuit 334 (e.g., voltage divider circuit, Zener diode (illustrated in FIG. 2), transistors, resistor, etc.). The voltage limiting circuit 334 is disposed inside the first connector 302 to protect it from the water and is sized to be lower than the breakdown voltage of the positive contacts 310, 318.

When the first and second connectors 302, 306 are mated, a high resistance fluid (e.g., water) path (e.g., channel) 338 is established between the first face 304 of the first connector 302 and the second face 308 of the second connector 306. Specifically, a high resistance water path extends between the contact surface 332 of the auxiliary electrode 330 and the contact surfaces 316, 324 of the first and second negative contacts 312, 320.

During operation, the auxiliary electrode 330 passes or leaks current (leakage current) 340 into the water path 338. The leakage current 340 creates a voltage drop $V_{D2}$ along the water path 338 (i.e., between the auxiliary electrode 330 and the negative contacts 312, 320). The voltage drop $V_{D2}$ creates a voltage in the water that is approximately equal to the applied voltage from the high voltage source 326 minus the voltage across the voltage limiting circuit 334, i.e., between the auxiliary electrode 330 and the positive contacts 310, 318.

Thus, the applied high voltage minus the voltage drop $V_{D2}$ creates a voltage differential between the transition metal contacts 310, 318 and the surrounding water that is equal to the voltage across the voltage limiting circuit 334, which is less than the breakdown voltage of the positive (transition metal) contacts 310, 318. Thus, the voltage on the positive contacts 310, 318 does not exceed the breakdown voltage of the transition metal and thus, can be used in high voltage (voltages exceeding the breakdown voltage of the transition metal) applications.

Figure 4:
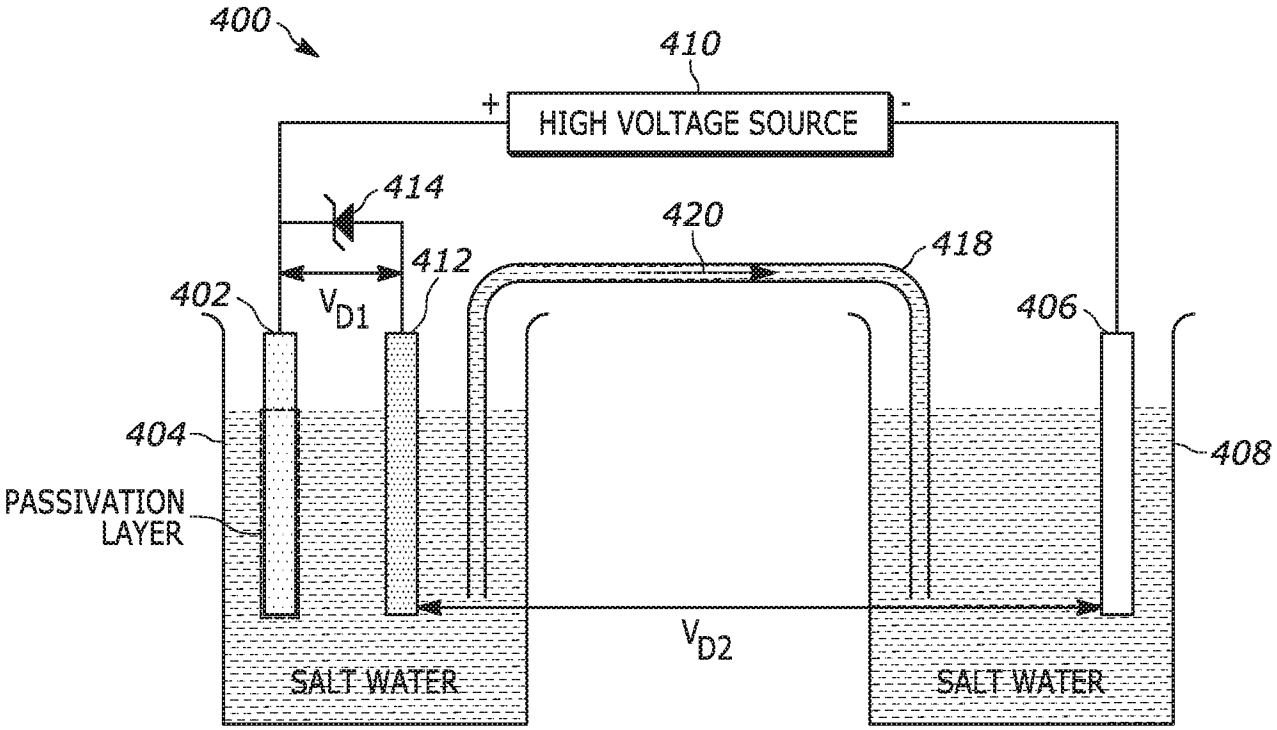
FIG. 4 is an illustration of an example test fixture demonstrating the operation of the high voltage electrical connector.

FIG. 4 is an example test fixture 400 demonstrating how the high voltage underwater electrical connector functions. The test fixture 400 includes a positive contact 402 made from a transition metal (e.g., niobium) immersed in a first beaker of a fluid (e.g., saltwater) 404 and a negative contact 406 made from a conductive material (e.g., graphite) immersed in a second beaker of a fluid (e.g., saltwater) 408. The passivation layer forms on the positive contact 402 when the positive contact 402 is immersed in the first beaker of water 404. A high voltage source 410 is connected to the positive and negative contacts 402, 406. An auxiliary (guard) electrode 412 made from a conductive material (e.g., graphite) is immersed in the first beaker of saltwater 404. The auxiliary electrode 412 is connected to the positive contact 402 via a voltage limiting circuit 414. In the example test fixture 400, the voltage limiting circuit 414 is comprised of a 60V Zener diode equivalent circuit (e.g., an npn transistor and a small Zener diode). A high resistance water path (e.g., channel) 418 is established between the first and second beakers 404, 408 (i.e., between the auxiliary electrode 412 and the negative contact 406 by using a small diameter (approximately 1 mm in diameter) saltwater-filled tube where opposite ends of the tube are immersed in the first and second beakers 404, 408 respectively.

During the test, 320 volts was applied to the positive (transition metal) contact 402 via the high voltage source 410. In this case, 320 volts exceeds the breakdown voltage of the positive transition metal contact 402 (niobium). The auxiliary electrode 412 leaks current (leakage current 420) into the saltwater of the first beaker 404. The leakage current 420 travels through the high resistance water path 418 to the negative contact 406 in the second beaker 408, thereby creating a voltage drop $V_{D2}$ across the high resistance water path 418 (i.e., between the auxiliary electrode 412 and the negative contact 406).

The voltage applied to the auxiliary electrode 412 from the high voltage source 410 is 320 volts minus the voltage $V_{D1}$ across the Zener diode voltage (i.e., 60 volts) which equals 260 volts. The voltage drop across the high resistance water path 418 was measured using a standard voltmeter to be approximately 260 volts. Thus, the voltage difference between the saltwater in the first and second beakers 404, 408 is approximately 260 volts. As a result, the voltage applied to the positive contact 402 relative to the voltage of the saltwater in beaker 404 is 320 volts minus the voltage drop of approximately 260 volts, which is approximately 60 volts.

Thus, the voltage drop $V_{D2}$ creates a voltage differential between the positive transition metal contact 402 and the saltwater in beaker 404 that is less than the breakdown voltage of the positive (transition metal) contact 402. In other words, the voltage of the positive (transition metal) contact 402 relative to the saltwater in beaker 404 is less than the breakdown voltage of the transition metal contact 402. Therefore, the insulating passive film (passivation layer) on the positive contact 402 was preserved and not destroyed by the high voltage applied to the positive contact 402. As a result, transition metal contacts can be used in high voltage (voltages exceeding the breakdown voltage of the transition metal) applications.

The descriptions above constitute examples of the disclosure. It is, of course, not possible to describe every conceivable combination of components or method for purposes of describing the disclosure, but one of ordinary skill in the art will recognize that many further combinations and permutations of the disclosure are possible. Accordingly, the disclosure is intended to embrace all such alterations, modifications, and variations that fall within the scope of this application, including the appended claims.

What is claimed is:

1. A system comprising:

a first connector that includes a first positive contact and a first negative contact;

a second connector that includes a second positive contact and a second negative contact, the first positive contact and the second positive contact being made from a self-passivating transition metal, wherein the self-passivating transition metal has a property of forming a non-conductive outer layer on the first positive contact and the second positive contact when immersed in a fluid or other corrosive environments; and an auxiliary electrode made from a conductive material electrically connected to at least one of the first positive contact and the second positive contact and spaced apart from a mating end of the first positive contact and the second positive contact, wherein when the first positive contact is mated with the second positive contact while immersed in the fluid and a high voltage source is applied to the first positive contact and the second positive contact that exceeds a breakdown voltage of the self-passivating transition metal, a high resistance fluid pathway is created from the auxiliary electrode to the first and second negative contacts, the auxiliary electrode being configured to pass current into and along the high resistance fluid pathway to create a voltage drop in the fluid between the auxiliary electrode and the first and second negative contacts, thereby limiting the voltage applied to the first and second positive contacts relative to the fluid to a voltage below the breakdown voltage of the self-passivating transition metal.

2. The system of claim 1, further comprising a voltage limiting circuit that electrically connects the auxiliary electrode to at least one of the first positive contact and the second positive contact.

3. The system of claim 2, wherein the voltage limiting circuit limits the voltage between first and second positive contacts and the auxiliary electrode.

4. The system of claim 2, wherein the voltage limiting circuit includes a Zener diode, transistor, or other electronic circuit.

5. The system of claim 4, wherein the voltage between the first and second positive contacts and the auxiliary electrode is limited to a voltage of the voltage limiting circuit.

6. The system of claim 1, wherein when the first positive contact is mated with the second positive contact while immersed in the fluid, at least a portion of the non-conductive outer layer is removed from the first positive contact and from the second positive contact via scraping to form an electrically conductive connection.

7. The system of claim 1, wherein the self-passivating transition metal is selected from a group comprising niobium, tantalum, titanium, zirconium, molybdenum, ruthenium, rhodium, palladium, hafnium, tungsten, rhenium, osmium, and iridium.

8. The system of claim 1, wherein the first connector is a male connector that includes a plurality of fingers having a first positive contact disposed at an end of one of the plurality of fingers and a first negative contact disposed at an end of another one of the plurality of fingers and the second connector is a female connector that includes a plurality of sockets having a second positive contact disposed inside one of the plurality of sockets and a second negative contact disposed inside another one of the plurality of sockets and wherein when the first and second connectors are mated, the plurality of fingers extend into the plurality of sockets such that the first positive contact and the first negative contact engage and mate with the second positive contact and the second negative contact respectively to form a tight fit.

9. The system of claim 1, wherein the first connector includes a first face, a first positive contact having a contact surface flush with the first face, and a first negative contact having a contact surface flush with the first face, and wherein the second connector includes a second face, a second positive contact having a contact surface flush with the second face, and a second negative contact having a contact surface flush with the second face.

10. The system of claim 9, wherein the auxiliary electrode forms a ring around at least one of the first positive contact and the second positive contact, the auxiliary electrode having a contact surface that is flush with at least one of the first face of the first connector and the second face of the second connector.

11. A high-voltage underwater electrical connector comprising:

a first positive contact made from a self-passivating transition metal;

a second positive contact made from a self-passivating transition metal that mates with the first positive contact, the first positive contact and the second positive contact being made from the self-passivating transition metal, wherein the self-passivating transition metal has a property of forming a non-conductive outer layer on the first positive contact and the second positive contact when immersed in water;

a first negative contact;

a second negative contact that mates with the first negative contact;

an auxiliary electrode made from a conductive material electrically connected to the first positive contact and spaced apart from a mating end of the first positive contact and the second positive contact; and a voltage limiting circuit that electrically connects the auxiliary electrode to the first positive contact, the voltage limiting circuit limiting a voltage between first and second positive contacts and the auxiliary electrode, wherein when the first positive contact is mated with the second positive contact while immersed in the water and a high voltage source is applied to the first positive contact and the second positive contact that exceeds a breakdown voltage of the self-passivating transition metal, a high resistance water pathway is created from the auxiliary electrode to the first and second negative contacts and the auxiliary electrode is configured to pass current into and along the high resistance water pathway to create the voltage drop in the water between the auxiliary electrode and the first and second negative contacts, thereby limiting the voltage applied to the first and second positive contacts relative to the water to a voltage below the breakdown voltage of the self-passivating transition metal.

12. The high-voltage underwater electrical connector of claim 11, wherein when the first positive contact is mated with the second positive contact while immersed in the water, at least a portion of the non-conductive layer outer is removed from the first positive contact and from the second positive contact via scraping to form an electrically conductive connection.

13. The high-voltage underwater electrical connector of claim 11, wherein the self-passivating transition metal is selected from a group comprising niobium, tantalum, titanium, zirconium, molybdenum, ruthenium, rhodium, palladium, hafnium, tungsten, rhenium, osmium, and iridium.

14. The high-voltage underwater electrical connector of claim 11, further comprising a first connector and a second connector, wherein the first connector is a male connector that includes a plurality of fingers having the first positive contact disposed at an end of one of the plurality of fingers and the first negative contact disposed at an end of another one of the plurality of fingers and the second connector is a female connector that includes a plurality of sockets having the second positive contact disposed inside one of the plurality of sockets and the second negative contact disposed inside another one of the plurality of sockets and wherein when the first and second connectors are mated, the plurality of fingers extend into the plurality of sockets such that the first positive contact and the first negative contact engage and mate with the second positive contact and the second negative contact respectively to form a tight fit.

15. The high-voltage underwater electrical connector of claim 11, wherein the voltage limiting circuit includes a Zener diode, transistor, or other electronic circuit.

16. The high-voltage underwater electrical connector of claim 11, wherein a voltage between the auxiliary electrode and the first positive contact is limited to a voltage limiting circuit voltage.

17. The high-voltage underwater electrical connector of claim 11, wherein the first and second negative contacts are made from a conductive material selected from a group comprising copper, graphite, platinum, mixed-metal oxides and aluminum.

18. The high-voltage underwater electrical connector of claim 11, wherein the auxiliary electrode is made from a conductive metal selected from a group comprising platinum, graphite, and mixed-metal oxides.

19. The high-voltage underwater electrical connector of claim 11, wherein the first connector includes a first face, a first positive contact having a contact surface flush with the first face, and a first negative contact having a contact surface flush with the first face, and wherein the second connector includes a second face, a second positive contact having a contact surface flush with the second face, and a second negative contact having a contact surface flush with the second face.

20. The high-voltage underwater electrical connector of claim 19, wherein the auxiliary electrode forms a ring around at least one of the first positive contact and the second positive contact, the auxiliary electrode having a contact surface that is flush with at least one of the first face of the first connector and the second face of the second connector.

* * * * *